US008502123B2

(12) United States Patent
Jeong et al.

(10) Patent No.: US 8,502,123 B2
(45) Date of Patent: Aug. 6, 2013

(54) APPARATUS AND METHOD TO PROTECT HALF OR FULL BRIDGE CIRCUIT INCLUDING FIRST SWITCHING UNIT AND SECOND SWITCHING UNIT IN IMAGE FORMING APPARATUS PERFORMING INDUCTION HEATING

(75) Inventors: An-sik Jeong, Hwaseong-si (KR); Kyung-hwan So, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 393 days.

(21) Appl. No.: 12/765,094

(22) Filed: Apr. 22, 2010

(65) Prior Publication Data

US 2011/0058826 A1 Mar. 10, 2011

(30) Foreign Application Priority Data

Sep. 7, 2009 (KR) ..... 10-2009-0083984

(51) Int. Cl.
*H05B 6/04* (2006.01)

(52) U.S. Cl.
USPC ..... 219/668; 399/33; 399/67

(58) Field of Classification Search
USPC ..... 399/33, 67; 219/668
See application file for complete search history.

(56) References Cited

U.S. PATENT DOCUMENTS

| | | | | |
|---|---|---|---|---|
| 5,365,397 | A * | 11/1994 | Kadota | 361/94 |
| 5,536,920 | A * | 7/1996 | Kwon | 219/663 |
| 2004/0179874 | A1* | 9/2004 | Kinouchi et al. | 399/328 |
| 2008/0031652 | A1* | 2/2008 | Yoda | 399/94 |

FOREIGN PATENT DOCUMENTS

| | | |
|---|---|---|
| KR | 1994-0013781 | 6/1994 |
| KR | 2000-0066088 | 11/2000 |

* cited by examiner

*Primary Examiner* — Walter L Lindsay, Jr.
*Assistant Examiner* — Benjamin Schmitt
(74) *Attorney, Agent, or Firm* — Stanzione & Kim, LLP

(57) ABSTRACT

An apparatus to protect a half or full bridge circuit including a first switching unit and a second switching unit in an image forming apparatus performing induction heating, the apparatus including a switching control unit to control operations of the first switching unit and the second switching unit by generating and outputting a first driving signal to turn on or off the first switching unit and a second driving signal to turn on or off the second switching unit; and an arm-short detecting unit to output a disable signal to stop operation of the switching control unit in response to the first driving signal and the second driving signal simultaneously being signals to turn on the first switching unit and the second switching unit.

22 Claims, 6 Drawing Sheets

APPARATUS AND METHOD TO PROTECT HALF OR FULL BRIDGE CIRCUIT INCLUDING FIRST SWITCHING UNIT AND SECOND SWITCHING UNIT IN IMAGE FORMING APPARATUS PERFORMING INDUCTION HEATING

CROSS-REFERENCE TO RELATED APPLICATIONS

This application claims the benefit under 35 U.S.C. §119 (a) of Korean Patent Application No. 10-2009-0083984, filed on Sep. 7, 2009, in the Korean Intellectual Property Office, the disclosure of which is incorporated herein by reference in its entirety.

BACKGROUND

1. Field of the Invention

The present general inventive concept relates to an apparatus and method to protect a half or full bridge circuit including a first switching unit and a second switching unit in an image forming apparatus performing induction heating.

2. Description of the Related Art

Image forming apparatuses use induction heating in order to reduce a warm-up time (WUT). In order to perform induction heating, a separate driver, such as an inverter, is necessary. A power topology for driving an inverter may be class E, a half bridge, or a full bridge. Among them, half bridges and full bridges are often used. If a half bridge or a full bridge are used as a power topology for driving an inverter, an arm-short phenomenon by which switches of respective poles, that is, a switching unit of a high side and a switching unit of a low side, are simultaneously turned on should be prevented.

SUMMARY

Example embodiments of the present general inventive concept provide an apparatus and method to protect a half or full bridge circuit including a first switching unit and a second switching unit in an image forming apparatus which performs induction heating.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an apparatus to protect a half or full bridge circuit including a first switching unit and a second switching unit in an image forming apparatus performing induction heating, the apparatus including a switching control unit to control operations of the first switching unit and the second switching unit by generating and outputting a first driving signal to turn on or off the first switching unit and a second driving signal to turn on or off the second switching unit; and an arm-short detecting unit to output a disable signal to stop operation of the switching control unit in response to the first driving signal and the second driving signal simultaneously being signals to turn on the first switching unit and the second switching unit.

The foregoing and/or other features and utilities of the present general inventive concept may also be achieved by providing a method of protecting a half or full bridge circuit including a first switching unit and a second switching unit in an image forming apparatus performing induction heating, the method including outputting a first driving signal to turn on or off the first switching unit and a second driving signal to turn on or off the second switching unit to the first switching unit and the second switching unit, respectively; and stopping output of the first driving signal and the second driving signal in response to the first and second driving signals simultaneously being high signals.

The foregoing and/or other features and utilities of the present general inventive concept may also be achieved by providing a computer-readable recording medium having recorded thereon a program to cause a computer to perform a method of protecting a half or full bridge circuit including a first switching unit and a second switching unit in an image forming apparatus performing induction heating, the method including outputting a first driving signal to turn on or off the first switching unit and a second driving signal to turn on or off the second switching unit to the first switching unit and the second switching unit, respectively; and stopping output of the first driving signal and the second driving signal in response to the first and second driving signals simultaneously being high signals.

The foregoing and/or other features and utilities of the present general inventive concept may also be achieved by providing an image forming apparatus which performs induction heating using a half or full bridge circuit including a plurality of switches, including a switching control circuit to respectively output control signals to the plurality of switches, and an arm-short detecting circuit to disable the switching control circuit in response to a plurality of the control signals being simultaneously output as switch-on signals.

The control signals output by the switching control circuit to the switches may also be output to the arm-short detecting circuit.

The arm-short detecting circuit may disable the switching control circuit by transmitting an interrupt signal to the arm-short detecting circuit.

The arm-short detecting circuit may output a signal to cause an error message to be displayed by the image forming apparatus.

The foregoing and/or other features and utilities of the present general inventive concept may also be achieved by providing a method of controlling a plurality of switches of a half or full bridge circuit in an image forming apparatus that performs induction heating, the method including respectively outputting control signals from a switching control circuit to the plurality of switches, and disabling the switching control circuit in response to a plurality of the control signals being simultaneously output as switch-on signals.

The method may further include outputting the control signals to an arm-short detecting circuit which disables the switching control circuit with an interrupt signal.

The method may further include outputting a signal from the arm-short detecting circuit to cause an error message to be displayed by the image forming apparatus.

BRIEF DESCRIPTION OF THE DRAWINGS

The above and/or other features and advantages of the present general inventive concept will become apparent and more readily appreciated from the following description of the embodiments, taken in conjunction with the accompanying drawings of which.

DETAILED DESCRIPTION OF THE EMBODIMENTS

Figure 1:
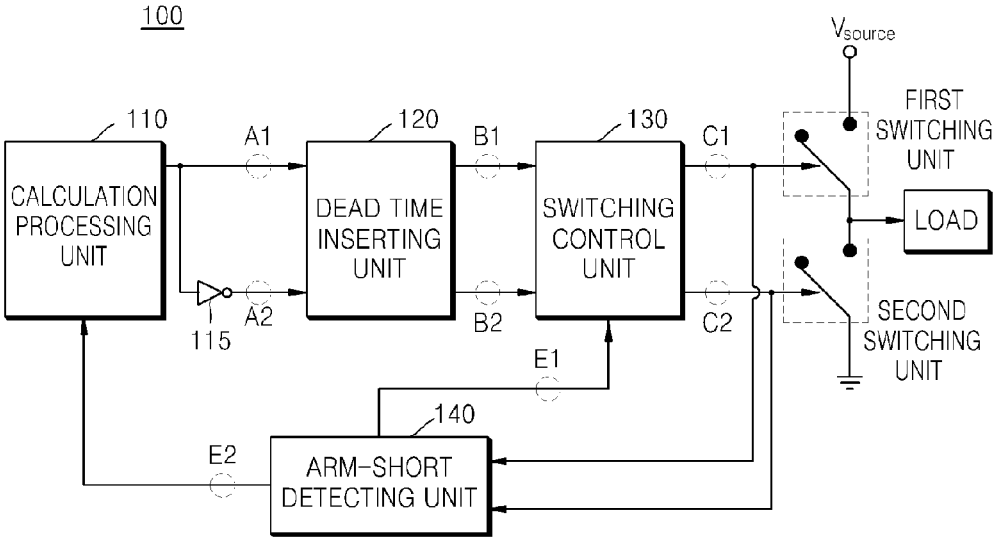
FIG. 1 is a block diagram illustrating an apparatus to protect a half or full bridge circuit including a first switching unit and a second switching unit in an image forming apparatus which performs induction heating, according to an embodiment of the present general inventive concept.

Reference will now be made in detail to various exemplary embodiments of the present general inventive concept, examples of which are illustrated in the accompanying drawings, wherein like reference numerals refer to like elements throughout. The embodiments are described below in order to explain the present general inventive concept by referring to the figures.

Figure 10:
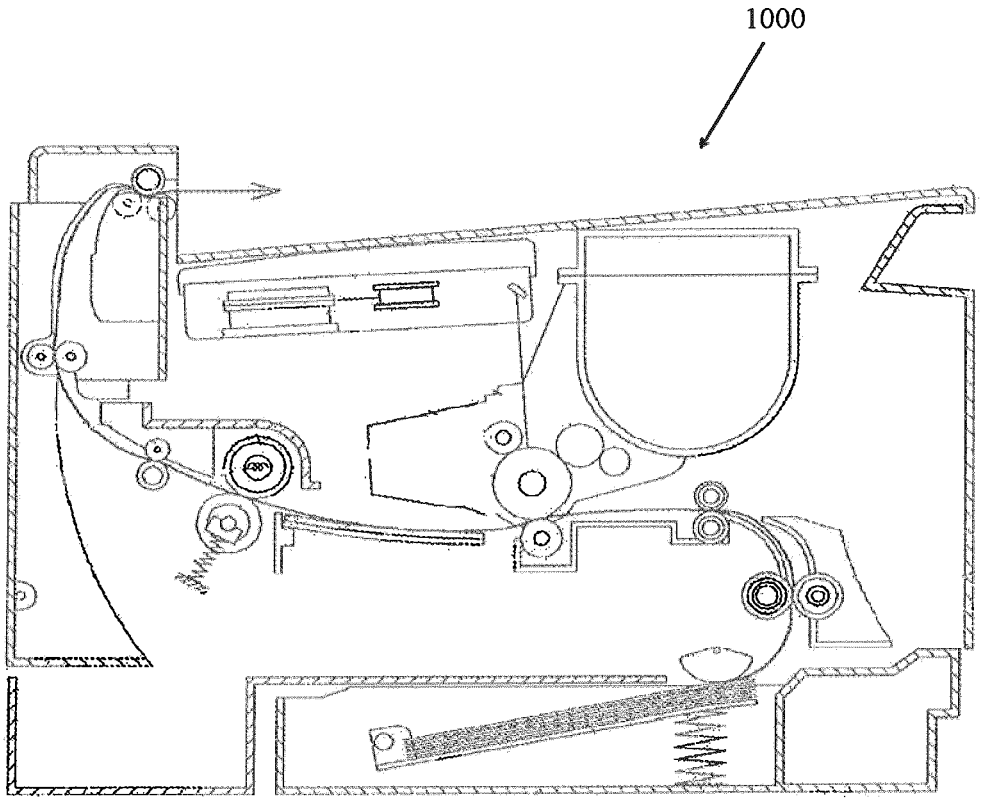
FIG. 10 is a view illustrating the configuration of an image forming apparatus performing induction heating according to an embodiment of the present general inventive concept.

FIG. 1 is a block diagram illustrating an apparatus 100 to protect a half or full bridge circuit including a first switching unit and a second switching unit in an image forming apparatus 1000, as illustrated in FIG. 10, which performs induction heating according to an embodiment of the present general inventive concept.

Referring to FIG. 1, the apparatus 100 may include a calculation processing unit 110, a dead time inserting unit 120, a switching control unit 130, and an arm-short detecting unit 140.

The calculation processing unit 110 may generate and output a first pulse width modulation (PWM) signal. The first PWM signal may be composed of high portions and low portions having a constant pulse width. An output terminal of the calculation processing unit 110 may be branched off into a first line A1 and a second line A2. The first PWM signal may therefore be output to the first line A1 and to the second line A2. An inverter 115 may be connected to the second line A2. When the first PWM signal is input to an input terminal of the inverter 115, the first PWM signal may be inverted and then output from an output terminal of the inverter 115 as a second PWM signal. The calculation processing unit 110 and the dead time inserting unit 120 may be connected to each other via the first line A1 and the second line A2.

The dead time inserting unit 120 may include a first input terminal and a second input terminal. The first PWM signal may be input to the first input terminal of the dead time inserting unit 120 via the first line A1, and the second PWM signal may be input to the second input terminal of the dead time inserting unit 120 via the second line A2. The dead time inserting unit 120 may delay a time of the first PWM signal and the second PWM signal to change a level of the first PWM signal and the second PWM signal from a low signal to a high signal. A signal obtained by delaying the first PWM signal may be referred to as a first signal, and a signal obtained by delaying the second PWM signal may be referred to as a second signal. The first signal may be output through a third line B1 connected to a first output terminal of the dead time inserting unit 120, and the second signal may be output through a fourth line B2 connected to a second output terminal of the dead time inserting unit 120. The first signal and the second signal may then be input to the switching control unit 130.

Figure 2:
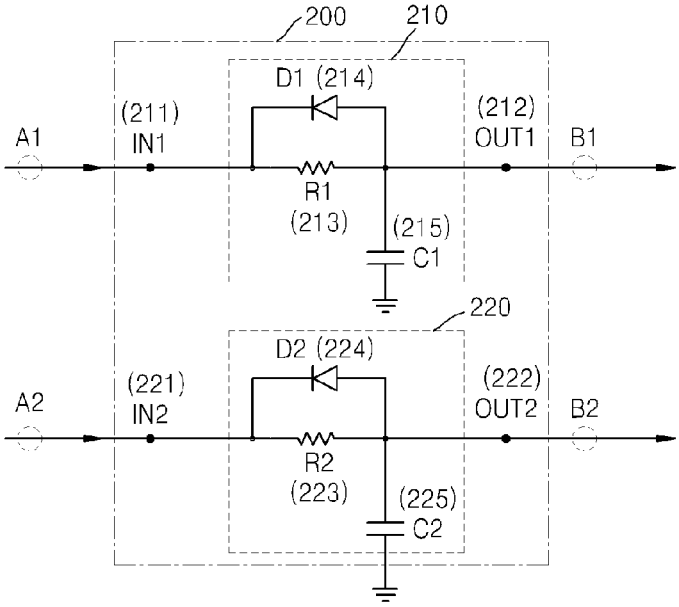
FIG. 2 is a circuit diagram illustrating a dead time inserting unit of the apparatus of FIG. 1 according to an embodiment of the present general inventive concept.

FIG. 2 is a circuit diagram illustrating a dead time inserting unit 200 of the apparatus of FIG. 1 according to an embodiment of the present general inventive concept. Referring to FIG. 2, the dead time inserting unit 200 may include a first RC filter 210 and a second RC filter 220.

The first RC filter 210 may include a first input terminal 211, a first output terminal 212, a first resistor 213, a first diode 214, and a first capacitor 215. The first PWM signal may be input to the first input terminal 211, and the first output terminal 212 may output the previously described first signal to the third line B1. The first resistor 213 may connect the first input terminal 211 and the first output terminal 212, the first diode 214 may be connected in parallel to the first resistor 213, a cathode terminal of the first diode 214 may be connected to the first input terminal 211, and an anode terminal of the first diode 214 may be connected to the first output terminal 212. The first capacitor 215 may have a first terminal connected to the first output terminal 212, and a second terminal connected to a reference voltage, e.g., the second terminal may be grounded.

The second RC filter 220 may include a second input terminal 221, a second output terminal 222, a second resistor 223, a second diode 224, and a second capacitor 225. A second PWM signal may be input to the second input terminal 221, and the second output terminal 222 may output the previously described second signal to the fourth line B2. The second resistor 223 may connect the second input terminal 221 and the second output terminal 222, the second diode 224 may be connected to the second resistor 223 in parallel, a cathode terminal of the second diode 224 may be connected to the second input terminal 221, and an anode terminal of the second diode 224 may be connected to the second output terminal 222. The second capacitor 225 may have a first terminal connected to the second output terminal 222, and a second terminal connected to a reference voltage, e.g., the second terminal may be grounded.

Referring to FIG. 1 again, the switching control unit 130 may include two input terminals. The previously described first signal may be input to a third input terminal of the switching control unit 130 via the third line B1, and the previously described second signal may be input to a fifth input terminal of the switching control unit 130 via the fourth line B2.

It is understood that the aforementioned input terminals of this embodiment of the switching control unit 130 are referred to as third and fifth input terminals to distinguish the input terminals of the switching control unit 130 from the first and second input terminals of the dead time inserting unit 120, as well as later discussed and similarly numbered additional input terminals of the switching control unit 130, rather than indicating a third and fifth of five input terminals of the switching control unit 130. Therefore, the third and fifth input terminals of the switching control unit 130 correspond respectively to the third line B1 and the fourth line B2 that connect the dead time inserting unit 120 to the switching control unit 130.

When the first signal and the second signal are input to the switching control unit 130, the switching control unit 130 may respectively compare the first signal and the second signal with a preset value, and may generate a first driving signal and a second driving signal as a high signal only in response to the first signal and the second signal being greater in size than the preset value, respectively. The first driving signal may be output to the first switching unit via a fifth line C1 connected to a third output terminal of the switching control unit 130, and the second driving signal may be output to the second switching unit via a sixth line C2 connected to a fourth output terminal of the switching control unit 130.

Again, it is understood that the output terminals of this embodiment of the switching control unit 130 are referred to as third and fourth output terminals to distinguish at least the output terminals of the switching control unit 130 from the first and second output terminals of the dead time inserting unit 120, rather than being a third and fourth of four output terminals of the switching control unit 130. Therefore, the third and fourth input terminals of the switching control unit 130 correspond respectively to the fifth line C1 and the sixth line C2 connected to the output terminals of the switching control unit 130. Additional input and output terminals discussed later in this description may use a similar numbering convention.

Figure 3:
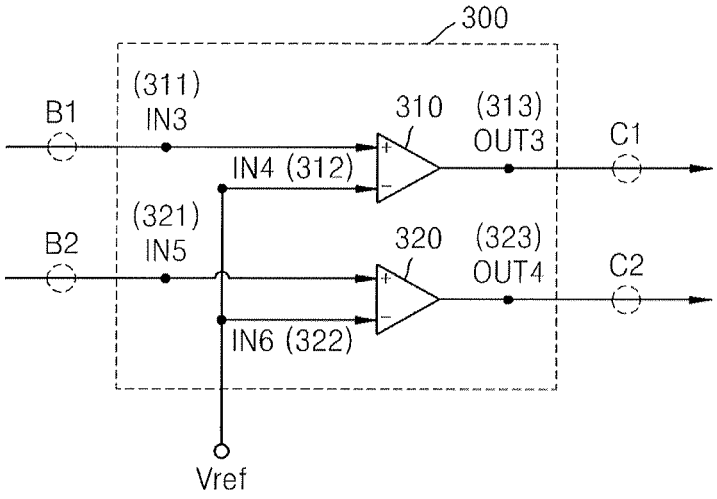
FIG. 3 is a circuit diagram illustrating a switching control unit of the apparatus of FIG. 1 according to an embodiment of the present general inventive concept.

FIG. 3 is a circuit diagram illustrating a switching control unit 300 of the apparatus 100 of FIG. 1 according to an embodiment of the present general inventive concept. Referring to FIG. 3, the switching control unit 300 may include a first comparator 310 and a second comparator 320.

The first comparator 310 may include a third input terminal 311 that may receive the previously described first signal output from the dead time inserting unit 120, and a fourth input terminal 312 that may receive a preset value as a reference voltage. The first comparator 310 may compare the first signal input via the third input terminal 311 with the received reference signal input via the fourth input terminal 312, and may generate a first driving signal which is a high signal only in response to the first signal being greater than the received reference signal. Also, the first comparator 310 may include a third output terminal 313 that may output the first driving signal. The first driving signal may be output through the fifth line C1, which may be connected to the third output terminal 313, to the first switching unit illustrated in FIG. 1.

The second comparator 320 may include a fifth input terminal 321 that may receive the previously described second signal output from the dead time inserting unit 120, and a sixth input terminal 322 that may receive the previously described preset reference voltage. The second comparator 320 may compare the second signal input through the fifth input terminal 321 with the received reference voltage input through the sixth input terminal 322, and may generate a second driving signal which is a high signal only in response to the second signal being greater than the received reference voltage. Also, the second comparator 320 may include a fourth output terminal 323 that may output the second driving signal. The second driving signal may be output through the sixth line C2, which may be connected to the fourth output terminal 323, to the second switching unit illustrated in FIG. 1.

Figure 4:
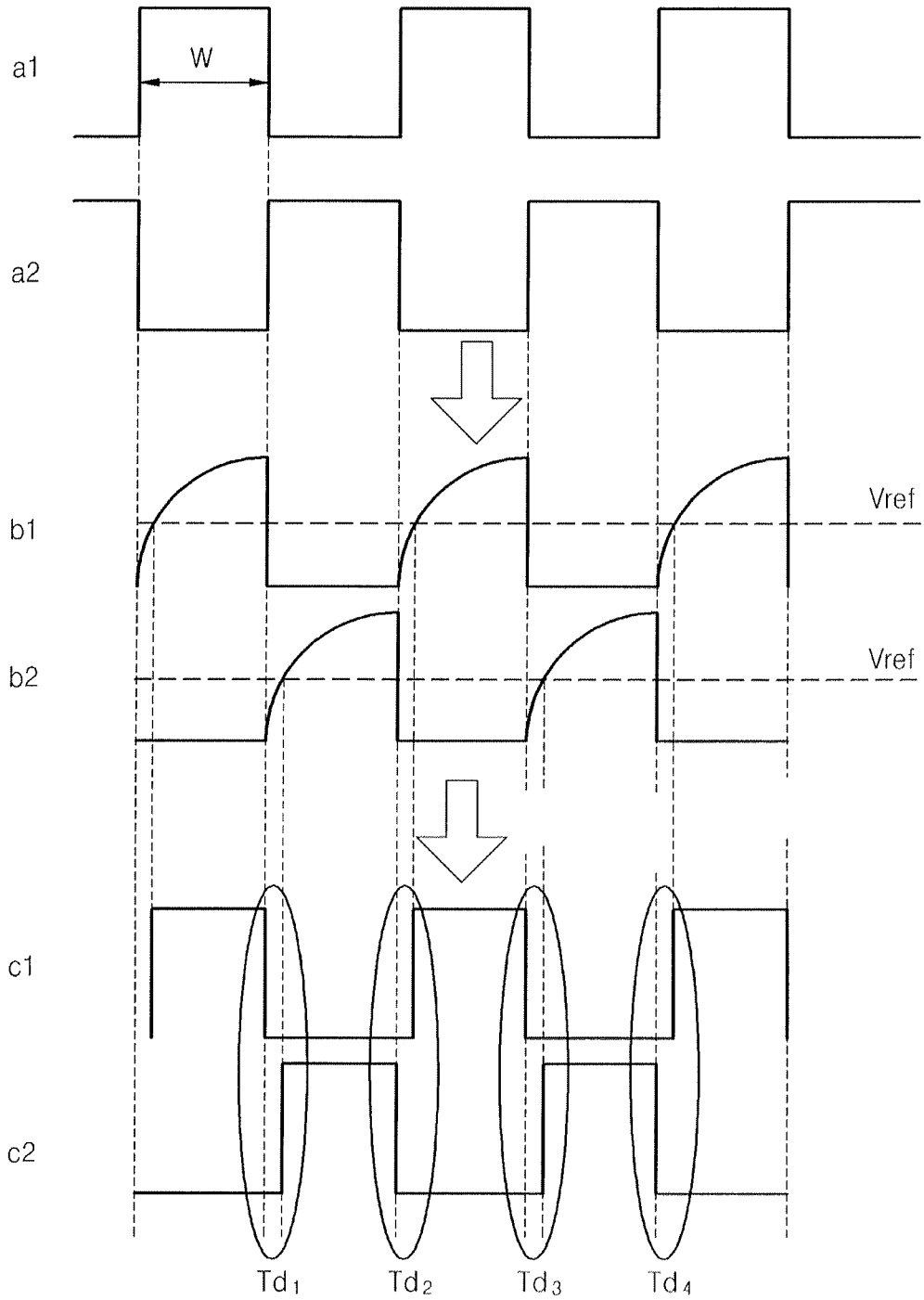
FIG. 4 illustrates waveforms of signals input to and output from elements of the apparatus of FIG. 1 according to an embodiment of the present general inventive concept.

FIG. 4 illustrates waveforms of signals input/output to/from elements of the apparatus 100 of FIG. 1 according to an embodiment of the present general inventive concept.

In FIG. 4, a signal a1 illustrates a possible waveform of the first PWM signal input through the first line A1 to the dead time inserting unit 120, and a signal a2 illustrates a possible waveform of the second PWM signal input through the second line A2 to the dead time inserting unit 120. As illustrated by the signals a1 and a2 of FIG. 4, the first PWM signal may have a waveform having a constant width W, and the second PWM signal may have a waveform that is inverted in form relative to the waveform of the first PWM signal.

In FIG. 4, a signal b1 illustrates a possible waveform of the previously described first signal output through the third line B1 from the dead time inserting unit 120, and a signal b2 illustrates a possible waveform of the previously described second signal output through the fourth line B2 from the dead time inserting unit 120. In FIG. 4, the first PWM signal and the second PWM signal input to the dead time inserting unit 120 may be respectively filtered using two RC filters. The first PWM signal may be filtered by a first RC filter to generate the first signal obtained by delaying an amount of time taken to change from a low signal to a high signal as illustrated by the signals b1 and b2 of FIG. 4. In other words, rather than having a signal that goes from a low value to a high value in a substantially immediate fashion, such as with a step function signal, the signal output from the dead time inserting unit 120 may go to a high value gradually over the width W of the high value of the first PWM signal waveform. Also, the second signal may have substantially the same waveform as the first signal.

In FIG. 4, a waveform of the first driving signal output through the fifth line C1 from the switching control unit 130 is illustrated as a signal c1, and a waveform of the second driving signal output through the sixth line C2 from the switching control unit 130 is illustrated as a signal c2. As illustrated by the signals c1 and c2 of FIG. 4, the first signal and a reference voltage Vref, which is the previously described preset value, are compared with each other and the first driving signal is output as a high signal only when the first signal is greater than the reference voltage Vref. Likewise, the second signal is compared with the reference voltage Vref and the second driving signal is output as a high signal only when the second voltage is greater than the reference voltage Vref. As illustrated in the signals c1 and c2, the forms of the first driving signal and the second driving signal are substantially square waveforms, and there are dead times Td1, Td2, Td3, and Td4 during which the first driving signal and the second driving signal are simultaneously output as low signals. Accordingly, theoretically, the first driving signal and the second driving should not be output as high signals simultaneously. However, high signals may exist simultaneously due to an operation error of the calculation processing unit 110, an error in a control program, and so on.

Referring to FIG. 1 again, the arm-short detecting unit 140 may receive the first driving signal and the second driving signal output from the switching control unit 130. If the first driving signal and the second driving signal are simultaneously output as high signals to turn on the first switching unit and the second switching unit, the arm-short detecting unit 140 may output a disable signal to the switching control unit 130 to stop the switching control unit 130 from operating, thereby preventing the first driving signal and the second driving signal from being output from the switching control unit 130. In FIG. 1, a driving signal that is output as a high signal may be a signal for turning on a switching unit. Accordingly, the arm-short detecting unit 140 may output the disable signal when the first driving signal and the second driving signal are simultaneously output as high signals.

Figure 5:
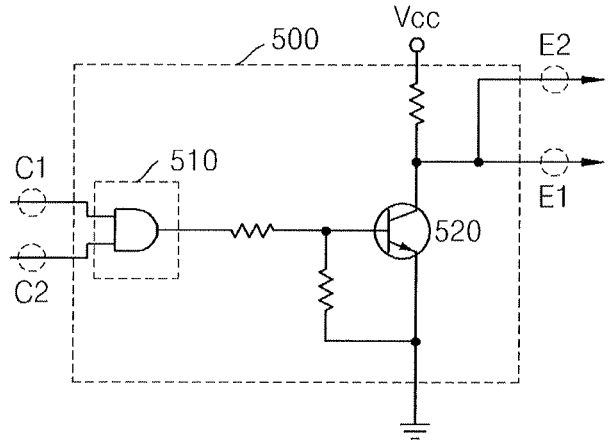
FIG. 5 is a circuit diagram illustrating an arm-short detecting unit of the apparatus of FIG. 1 according to an embodiment of the present general inventive concept.

FIG. 5 is a circuit diagram illustrating an arm-short detecting unit 500 of the apparatus of FIG. 1, according to an embodiment of the present general inventive concept. The arm-short detecting unit 500 may include an AND gate 510 and a transistor 520.

The first driving signal and the second driving signal may be input to the AND gate 510, and if the first driving signal and the second driving signal are simultaneously output as high signals, the AND gate 510 may output a high signal. The high signal output from the AND gate 510 may be input to a base of the transistor 520, and since a base-emitter voltage Vbe applied between the base and an emitter of the transistor 520 is greater than 0.7 V, a collector and the emitter are electrically connected to each other. The collector of the transistor 520 may be used as an output terminal to output a voltage Vcc, and since the output terminal may be connected to an electric potential connected to the emitter of the transistor 520, e.g., the output terminal may be grounded, when the collector and the emitter are electrically connected to each other, the output terminal of the transistor 520 may output the disable signal through a seventh line E1. In contrast, when a low signal is output from the AND gate 510, since the base-emitter voltage Vbe applied between the base and the emitter of the transistor 520 is not greater than 0.7 V, the collector and the emitter may not be electrically connected to each other. Since a driving voltage Vcc may be applied to the output terminal when the collector and the emitter are not electrically connected to each other, the output terminal may output an enable signal.

Figure 6:
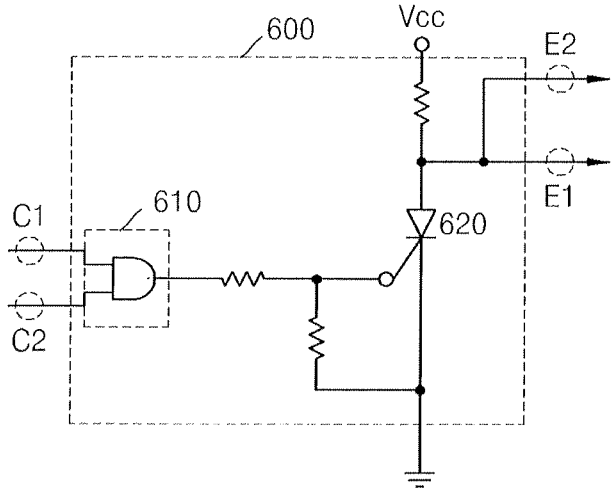
FIG. 6 is a circuit diagram illustrating an arm-short detecting unit of the apparatus of FIG. 1 according to another embodiment of the present general inventive concept.

FIG. 6 is a circuit diagram illustrating an arm-short detecting unit 600 of the apparatus of FIG. 1, according to another embodiment of the present general inventive concept. The arm-short detecting unit 600 of FIG. 6 may include a thyristor 620 instead of the transistor 520 of the arm-short detecting unit 500 of FIG. 5. Referring to FIG. 6, if a high signal output from an AND gate 610 is input to a gate of the thyristor 620, an anode and a cathode of the thyristor 620 may be electrically connected to each other. Accordingly, an output terminal connected to the anode of the thyristor 620 may be grounded, and the output terminal may output a disable signal through the seventh line E1.

Figure 7:
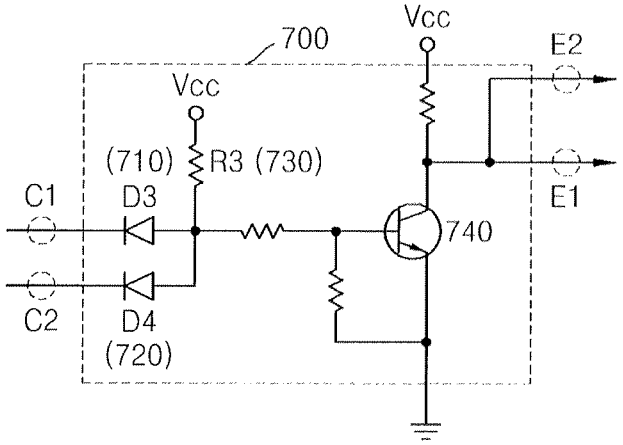
FIG. 7 is a circuit diagram illustrating an arm-short detecting unit of the apparatus of FIG. 1 according to still another embodiment of the present general inventive concept.

FIG. 7 is a circuit diagram illustrating an arm-short detecting unit 700 of the apparatus of FIG. 1, according to yet another embodiment of the present general inventive concept. The arm-short detecting unit 700 of FIG. 7 may include two diodes D3 and D4 and one resistor R3 instead of the AND gate 510 of the arm-short detecting unit 500 of FIG. 5.

The arm-short detecting unit 700 may include a third diode 710 having a cathode terminal to which the first driving signal is input, a fourth diode 720 having a cathode terminal to which the second driving signal is input, and a third resistor 730 having a first terminal connected to an anode terminal of the third diode 710 and an anode of the fourth diode 720, and a second terminal to which a driving voltage Vcc is applied, and such a configuration of these components may perform the same function as the AND gate 510 of the arm-short detecting unit 500 of FIG. 5. If high signals are simultaneously input through lines C1 and C2 to the third diode 710 and the fourth diode 720, since the third diode 710 and the fourth diode 720 are reversed biased, the third diode 710 and the fourth diode 720 may not conduct current. By contrast, if low signals are input to the third diode 710 and the fourth diode 720, since the third diode 710 and the fourth diode 720 are forward biased, the third diode 710 and the fourth diode 720 may conduct current. Accordingly, when a low signal is input to either the third diode 710 or the fourth diode 720, the low signal may be output to a transistor 740. However, if high signals are simultaneously input to the third diode 710 and the fourth diode 720, a high signal from a driving voltage Vcc may be output to the transistor 740. Accordingly, the third diode 710, the fourth diode 720, and the third resistor 730 may function as an AND gate.

Figure 8:
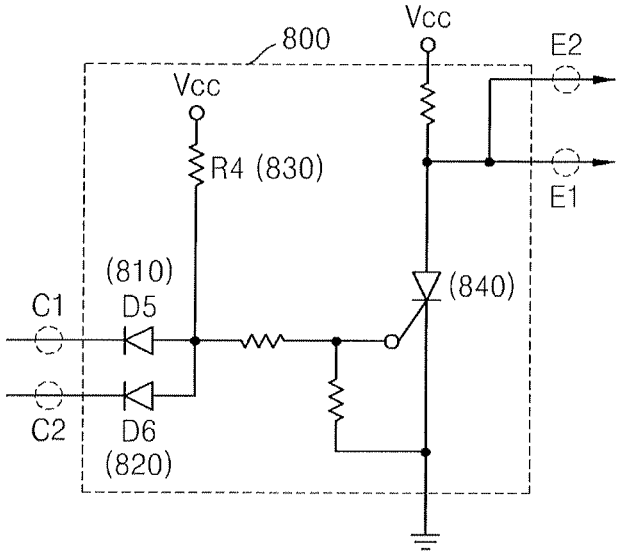
FIG. 8 is a circuit diagram illustrating an arm-short detecting unit of the apparatus of FIG. 1 according to yet another embodiment of the present general inventive concept.

FIG. 8 is a circuit diagram illustrating an arm-short detecting unit 800 of the apparatus of FIG. 1, according to still another embodiment of the present general inventive concept. The arm-short detecting unit 800 of FIG. 8 may include two diodes 810 and 820 and one resistor 830 to function as an AND gate, and a thyristor 840 instead of a transistor of the arm-short detecting unit 700 of FIG. 7.

Referring to FIG. 1 again, if the disable signal is output from the arm-short detecting unit 140, the operation of the switching control unit 130 may be stopped. Accordingly, the first driving signal and the second driving signal may not be output to the first switching unit and the second switching unit, thereby preventing an arm-short phenomenon in which the first switching unit and the second switching unit are simultaneously turned on. Also, if the first driving signal and the second driving signal output from the switching control unit 130 are simultaneously output as high signals, the arm-short detecting unit 140 may output a signal corresponding to the disable signal output to the switching control unit 130 to the calculation processing unit 110 through an eighth line E2. The calculation processing unit 110 may accordingly stop the operation of a system including the apparatus 100 of FIG. 1, and may display an error message.

Figure 9:
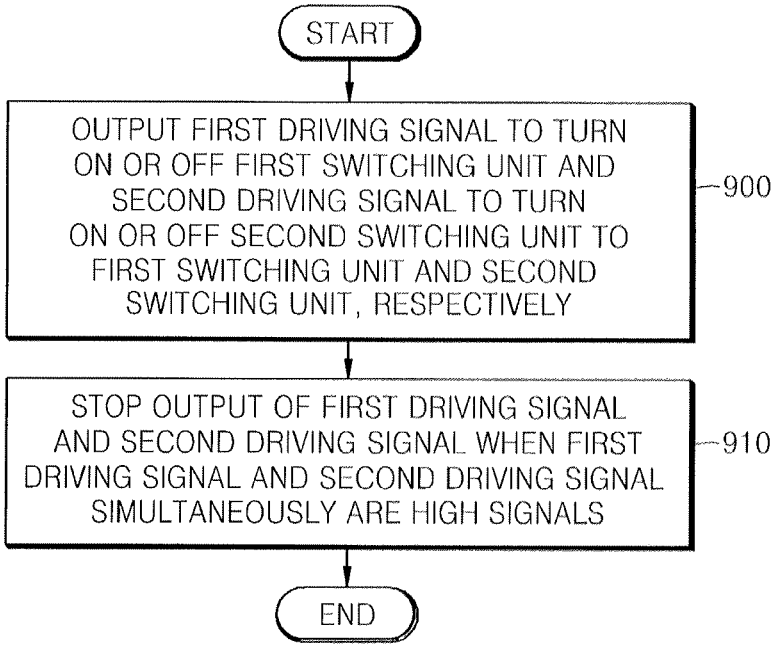
FIG. 9 is a flowchart illustrating a method of protecting a half or full bridge circuit including a first switching unit and a second switching unit in an image forming apparatus which performs induction heating according to an embodiment of the present general inventive concept.

FIG. 9 is a flowchart illustrating a method of protecting a half or full bridge circuit including a first switching unit and a second switching unit in an image forming apparatus performing induction heating, according to an embodiment of the present general inventive concept.

The method of protecting a half or full bridge circuit including a first switching unit and a second switching unit connected to each other in series in an image forming apparatus performing induction heating will now be explained with reference to the various embodiments of the apparatus illustrated in FIGS. 1 through 8.

In operation 900, a first driving signal to turn on or off a first switching unit and a second driving signal to turn on or off a second switching unit may be output to the first switching unit and the second switching unit, respectively. The first driving signal may be output as a high signal only when a first signal, for example, the signal b1 of FIG. 4, obtained by delaying a first PWM signal, for example, the signal a1 of FIG. 4, according to a preset value is greater than a preset value of a reference voltage. The second driving signal may be output as a high signal only when a second signal, for example, the signal b2 of FIG. 4 obtained by delaying a second PWM signal, for example, the signal a2 of FIG. 4, according to a preset value is greater than the preset value of the reference voltage. Accordingly, the forms of the first driving signal and the second driving signal may be square waveforms as shown in c1 and c2 of FIG. 4, and there may be dead times Td1, Td2, Td3, and Td4 in which the first driving signal and the second driving signal simultaneously are low signals. When the first or second driving signal is a high signal, the first or second switching unit may be respectively turned on, and when the first or second driving unit is a low signal, the first or second switching unit may be respectively turned off.

In operation 910, if the first driving signal and the second driving signal are simultaneously output as high signals, output of the first driving signal and the second driving signal may be stopped. When the first driving signal or the second driving signal is a high signal, the first switching unit or the second switching unit may be respectively turned on. If the first driving signal and the second driving signal are simultaneously output as high signals, the first switching unit and the second switching unit may be simultaneously turned on, thereby causing an arm-short phenomenon. Accordingly, when the first driving signal and the second driving signal are simultaneously output as high signals, the arm-short phenomenon may be prevented by preventing output of the first driving signal and the second driving signal. Also, a user may be informed there is something wrong by stopping the operation of the system and displaying an error message.

The present invention may be embodied as computer-readable codes on a computer-readable recording medium. The computer-readable recording medium is any data storage device that can store data that can be thereafter read by a computer system. Examples of the computer-readable recording medium include read-only memories (ROMs), random-access memories (RAMs), CD-ROMs, magnetic tapes, floppy disks, and optical data storage devices.

Although various exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An apparatus to protect a half or full bridge circuit including a first switching unit and a second switching unit in an image forming apparatus performing induction heating, the apparatus comprising:

a switching control unit to control operations of the first switching unit and the second switching unit by generating and outputting a first driving signal to turn on or off the first switching unit and a second driving signal to turn on or off the second switching unit; and an arm-short detecting unit to output a disable signal to stop operation of the switching control unit in immediate response to the first driving signal and the second driving signal simultaneously being signals to turn on the first switching unit and the second switching unit.

2. The apparatus of claim 1, further comprising:

a calculation processing unit to generate and output a first pulse width modulation (PWM) signal; and a dead time inserting unit to output a first signal and a second signal that are generated by delaying times during which the first PWM signal and a second PWM signal are changed from a low signal to a high signal, the second PWM signal being an inverted output of the first PWM signal, wherein the switching control unit compares the first signal and the second signal with a preset value and generates and outputs the first driving signal and the second driving signal as high signals in response to the first signal and the second signal being respectively greater than the preset value.

3. The apparatus of claim 2, wherein the arm-short detecting unit outputs a signal corresponding to the disable signal to the calculation processing unit, wherein the calculating processing unit stops the operation of a system including the apparatus according to the signal received from the arm-short detecting unit and displays an error message.

4. The apparatus of claim 2, wherein the dead time inserting unit comprises:

a first RC filter comprising:

a first input terminal to receive the first PWM signal, a first output terminal to output the first signal, a first resistor connecting the first input terminal and the first output terminal, a first diode connected in parallel to the first resistor and having a cathode terminal connected to the first input terminal and an anode terminal connected to the first output terminal, and a first capacitor having a first terminal connected to the first output terminal and a second terminal grounded; and a second RC filter comprising:

a second input terminal to receive the second PWM signal, a second output terminal to output the second signal, a second resistor connecting the second input terminal and the second output terminal, a second diode connected in parallel to the second resistor, and having a cathode terminal connected to the second input terminal and an anode terminal connected to the second output terminal, and a second capacitor having a first terminal connected to the second output terminal and a second terminal grounded.

5. The apparatus of claim 2, wherein the switching control unit comprises:

a first comparator comprising:

a third input terminal to receive the first signal, a fourth input terminal to receive the preset value as a reference voltage, and a third output terminal to output the first driving signal; and a second comparator comprising:

a fifth input terminal to receive the second signal, a sixth input terminal to receive the preset value as the reference voltage, and a fourth output terminal to output the second driving signal;

wherein the first comparator compares the first signal and the reference voltage and generates the first driving signal as a high signal in response to the first signal being larger than the reference voltage and the second comparator compares the second signal and the reference voltage and generates the second driving signal as a high signal in response to the second signal being larger than the reference voltage.

6. The apparatus of claim 2, wherein the arm-short detecting unit comprises:

an AND gate to output a high signal in response to the first driving signal and the second driving signal being simultaneously input as high signals; and a transistor to output a disable signal in response to the high signal output from the AND gate being input to a base of the transistor to electrically connect a collector and an emitter of the transistor.

7. The apparatus of claim 2, wherein the arm-short detecting unit comprises:

a third diode having a cathode terminal to which the first driving signal is input;

a fourth diode having a cathode terminal to which the second driving signal is input;

a third resistor having a first terminal connected to an anode terminal of the third diode and an anode terminal of the fourth diode, and a second terminal to which a driving voltage is applied; and a transistor to output a disable signal in response to a high signal output from the first terminal of the third resistor being input to a base of the transistor to electrically connect a collector and an emitter of the transistor, wherein the first terminal of the third resistor outputs the high signal in response to the first and second driving signals simultaneously being high signals.

8. The apparatus of claim 2, wherein the arm-short detecting unit comprises:

an AND gate to receive the first driving signal and the second driving signal, and to output a high signal in response to the first driving signal and the second driving signal simultaneously being high signals; and a thyristor to output the disable signal in response to the high signal output from the AND gate being input to a gate of the thyristor to allow current between an anode and a cathode of the thyristor.

9. The apparatus of claim 2, wherein the arm-short detecting unit comprises:

a fifth diode having a cathode terminal to which the first driving signal is input;

a sixth diode having a cathode terminal to which the second driving signal is input;

a fourth resistor having a first terminal connected to an anode terminal of the fifth diode and an anode terminal of the sixth diode, and a second terminal to which a driving voltage is applied; and a thyristor to output the disable signal in response to a high signal output from the first terminal of the fourth resistor being input to a gate of the thyristor to allow current between an anode and a cathode of the thyristor, wherein the first terminal of the fourth resistor outputs the high signal in response to the first and second driving signals simultaneously being high signals.

10. The apparatus of claim 1, wherein the first and second driving signals to turn on the first and second switching units are output as high signals.

11. A method of protecting a half or full bridge circuit including a first switching unit and a second switching unit in an image forming apparatus performing induction heating, the method comprising:

outputting a first driving signal to turn on or off the first switching unit and a second driving signal to turn on or off the second switching unit to the first switching unit and the second switching unit, respectively; and stopping output of the first driving signal and the second driving signal in immediate response to the first and second driving signals simultaneously being driving signals to turn on the first and second switching units, respectively.

12. The method of claim 11, wherein the first driving signal is output as a high signal in response to a first signal obtained by delaying according to a preset value a time during which a first PWM signal changes from a low signal to a high signal being greater than the preset value, and the second driving signal is output as a high signal in response to a second signal obtained by delaying according to the preset value a time during which a second PWM signal changes from a low signal to a high signal being greater than the preset value, the second PWM signal being an inverted output of the first PWM signal.

13. The method of claim 12 further comprising:

stopping operation of a system including the image forming apparatus performing the method in response to the first driving signal and the second driving signal simultaneously being output as high signals.

14. The method of claim 13, further comprising:

displaying an error message in response to the first driving signal and the second driving signal simultaneously being output as high signals.

15. A non-transitory computer-readable recording medium having recorded thereon a program to cause a computer to perform a method of protecting a half or full bridge circuit including a first switching unit and a second switching unit in an image forming apparatus performing induction heating, the method comprising:

outputting a first driving signal to turn on or off the first switching unit and a second driving signal to turn on or off the second switching unit to the first switching unit and the second switching unit, respectively; and stopping output of the first driving signal and the second driving signal in immediate response to the first and second driving signals simultaneously being driving signals to turn on the first and second switching units, respectively.

16. An image forming apparatus which performs induction heating using a half or full bridge circuit including a plurality of switches, comprising:

a switching control circuit to respectively output control signals to the plurality of switches; and an arm-short detecting circuit to disable the switching control circuit in immediate response to a plurality of the control signals being simultaneously output as switch-on signals.

17. The image forming apparatus of claim 16, wherein the control signals output by the switching control circuit to the switches are also output to the arm-short detecting circuit.

18. The image forming apparatus of claim 17, wherein the arm-short detecting circuit disables the switching control circuit by transmitting an interrupt signal to the arm-short detecting circuit.

19. The image forming apparatus of claim 18, wherein the arm-short detecting circuit outputs a signal to cause an error message to be displayed by the image forming apparatus.

20. A method of controlling a plurality of switches of a half or full bridge circuit in an image forming apparatus that performs induction heating, the method comprising:

respectively outputting control signals from a switching control circuit to the plurality of switches; and disabling the switching control circuit in immediate response to a plurality of the control signals being simultaneously output as switch-on signals.

21. The method of claim 20, further comprising:

outputting the control signals to an arm-short detecting circuit which disables the switching control circuit with an interrupt signal.

22. The method of claim 21, further comprising:

outputting a signal from the arm-short detecting circuit to cause an error message to be displayed by the image forming apparatus.

* * * * *